US006515636B2

(12) United States Patent
Munder et al.

(10) Patent No.: US 6,515,636 B2
(45) Date of Patent: Feb. 4, 2003

(54) ACTIVE ARRAY ANTENNA WITH FLEXIBLE MEMBRANE ELEMENTS AND TENSIONING ARRANGEMENT

(75) Inventors: Joseph Charles Munder, Doylestown, PA (US); Bronson Murray, Leesburg, VA (US); Clement Alphonse Berard, Jr., Pennington, NJ (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 09/833,549

(22) Filed: Apr. 12, 2001

(65) Prior Publication Data

US 2002/0149540 A1 Oct. 17, 2002

(51) Int. Cl.[7] ..... H01Q 1/20
(52) U.S. Cl. ..... 343/878; 343/705; 343/DIG. 2
(58) Field of Search ..... 343/DIG. 2, 878, 343/881, 853, 708, 915, 916; 244/158 R; H01Q 1/00, 1/20

(56) References Cited

U.S. PATENT DOCUMENTS 5,666,128 A 9/1997 Murray et al. ..... 343/878

*Primary Examiner*—Michael C. Wimer
(74) *Attorney, Agent, or Firm*—Scully, Scott, Murphy & Presser

(57) ABSTRACT

An array antenna including: a frame having a two-dimensional array of a plurality of openings; an electromagnetically radiating tile disposed in each opening; and mounting means for holding at least one tile in a corresponding opening of the frame, each of the mounting means comprising at least two biasing members, each biasing member exerting a biasing force on the tile relative to the frame. Preferably, each biasing member is a leaf spring having first and second ends attached to the frame and a bowed section attached to the tile. Furthermore, it is preferred that each biasing member further have a way to vary the biasing force with temperature, such as fabricating the bow portion from a first and second material, each having a different coefficient of thermal expansion. Also provided is a spacecraft which utilizes the array antenna of the present invention.

34 Claims, 6 Drawing Sheets

ACTIVE ARRAY ANTENNA WITH FLEXIBLE MEMBRANE ELEMENTS AND TENSIONING ARRANGEMENT

BACKGROUND OF THE INVENTION

1. Field of the Invention

The present invention relates generally to antennas for spacecraft and, more particularly, to a mounting means for individual radiating tiles within an antenna array.

2. Prior Art

The costs of communications spacecraft are under downward pressures due to competition among spacecraft manufacturers, and also due to competition with other forms of communications. Modularized spacecraft techniques are well known in the art. These techniques use standard modules to make spacecraft buses (payload carriers) of various sizes and capabilities, thereby reducing design costs, and particularly by reducing the need to space-qualify different structures which might be used to construct custom spacecraft using earlier techniques. Other techniques for reducing the costs of assembling buses have been implemented, such as misalignment tolerant fasteners.

Payloads have been more resistant to cost reduction, because they are, almost by definition, different from each other. Each spacecraft user specifies the number of communications channels which are to be carried, their frequencies, and the power to be delivered to a specified "footprint" on the Earth's surface. The electrical power modularization required to provide the desired total radio-frequency (RF) power is described in the prior art. The antennas, however, have been more resistant. In the past, reflector/feed antennas were used on the spacecraft, with the reflector and the feed being designed to provide the desired footprint over the specified frequency range. The reflector/feed arrangement using horn feed antennas exhibits high efficiency, which is very desirable in view of the electrical power limitations common to spacecraft. However, the reflector/feed antenna is difficult to design, and multiple feed horns may be required in order to provide the appropriate footprint.

Further, a reflector-type antenna is subject to physical distortion as a result of differential heating occasioned by insolation. The physical distortion, in turn, disrupts the desired footprint. Various RF-transparent insolation shields have been used to cover the radiating surface of reflector antennas, to minimize the distortion. To the extent that the thermal (or other) antenna distortion affects the footprint, no convenient remedy is available. When operation at a plurality of different frequency ranges is necessary, as when a satellite uplink and downlink are at different bands, such as C and X band, multiple reflector antennas are required, which exacerbates the abovementioned problems.

Further problems arise from the "frequency reuse" operating method, used to maximize the number of separate channels which may be used within each band, by transmitting alternate channels of each band with different polarizations, and using a polarization-sensitive reflector/feed arrangement, in that the reflector structure is much more complex than in a simple continuous reflector. The considerations relating to reflector/feed antennas have directed attention to other types of antennas for communications spacecraft, notably antenna arrays. Antenna arrays are well known in the art, and their use in conjunction with aircraft and spacecraft is well known, although the number of such arrays in actual use in spacecraft is very small, due to a number of practical problems. Among these problems is that of the size, weight, complexity, and the attenuation or loss of the beamformer, which is required to feed the RF signal to the antenna elements. Also, an array antenna must maintain a predetermined spacing between each antenna element and other elements of the array to prevent grating lobes.

Those skilled in the art know that antennas are reciprocal linear devices, in which the transducing characteristics during transmission and reception are the same. For example, the beamwidth, the gain (or more properly, the directive gain relative to an isotropic source) and the impedance at the feed points are the same in both transmitting and receiving modes. However, the terms used to describe antenna functions and characteristics were established at a time when this reciprocity was not apparent, and as a result the terms are suggestive of either transmission or reception, but generally not of both. Those skilled in the art know, therefore, that the description of an antenna may be couched in terms of either transmission or reception, or an intermixture of both, with the other mode of operation being understood therefrom. Thus, the term "feed port," for example, refers to the port to which signal energy is applied during transmission, and is also applied to that same port at which signal energy is received in a receiving mode.

Array antennas are of two general types, active and passive. The "active" antenna array includes active devices such as semiconductor devices to aid in reception or transmission, or both; a passive antenna array does not. The proper phase characteristics between the elements of the array must be provided in some way in either the active or passive arrays. An active antenna array will generally include controllable phase-shifters which can be used to adjust the phase of the RF signal being fed to one (or to a subset) of the antenna elements of the array. The need for a phase-shifting beamformer may be avoided by using a non-phase-controlled signal amplitude divider, in conjunction with control of the phase control elements associated with each element or subset of elements. An active antenna array will often have a transmit amplifier and a receive amplifier associated with each antenna or subset of antennas. These amplifiers add to the cost and complexity of the system, and are a major source of waste heat, which adds to the insolation heat, and must be taken into account. The cumulative effect of the heat absorbed by the array antenna, and that generated within the array antenna, tends to raise the temperature gradient of the array antenna, and to cause physical distortion, which in turn affects the radiation pattern and the resulting footprint. In general, antenna arrays for use in spacecraft have to address requirements to minimize weight, RF signal losses, and, in active embodiments, the energization power, as well as to satisfy waste heat removal requirements. The advantages of array antennas include the ability to control the beam characteristics by remote control of the phase shifters. Also, an array antenna may be folded for launch and then deployed or erected.

U.S. Pat. No. 5,666,128 to Murray et al. proposes the use of flexible beams by which each rigid tile, in an array of tiles, is attached to an antenna frame. The flexible beams via their bending properties, allow for expansion and contraction of the tile with respect to the frame thus preventing accumulation of tile distortions across the antenna array. However, the flexible beams do not tension the tile, instead they allow the rigid and relaxed tile to augment the otherwise inadequate lateral shear properties of the antenna frame via their tensile and compressive properties.

In view of the prior art, there is a need for an improved spacecraft antenna structure that bias an array of flexible membrane elements diagonally in tension such as to augment the otherwise inadequate lateral shear properties of the antenna frame.

SUMMARY OF THE INVENTION

Accordingly, an array antenna is provided. The array antenna comprises:

a frame having a two-dimensional array of a plurality of openings; an electromagnetically radiating tile disposed in each opening; and mounting means for holding at least one tile in a corresponding opening of the frame, each of the mounting means comprising at least two biasing members, each biasing member exerting a biasing force on the tile relative to the frame.

Preferably, each of the radiating tiles includes an array of radiating elements and the frame lies essentially in a plane, and the plane of each tile is parallel to the plane of the frame.

In a preferred implementation of the array antenna of the present invention, each biasing member comprises a leaf spring having first and second ends attached to the frame and a bowed section. In yet another preferred implementation of the array antenna of the present invention each biasing member further comprises means for varying the biasing force in response to a change in temperature. When the biasing members are leaf springs, the means for varying the biasing force in response to a change in temperature preferably comprises the bow portion being fabricated from a first and second material, each having a different coefficient of thermal expansion.

In a second preferred implementation of the array antenna of the present invention, the mounting means comprises a radial tensioning wire fastened to each of four corresponding comers of the tile at a first end and slipably disposed to a tensioning yoke at a second end, the tensioning yoke having a tensioning member for maintaining the radial wires and tile in tension.

BRIEF DESCRIPTION OF THE DRAWINGS

These and other features, aspects, and advantages of the apparatus and methods of the present invention will become better understood with regard to the following description, appended claims, and accompanying drawings where:

DETAILED DESCRIPTION OF THE PREFERRED EMBODIMENT

Although this invention is applicable to numerous and various types of antennas, it has been found particularly useful in the environment of antenna arrays for use in satellites. Therefore, without limiting the applicability of the invention to antenna arrays for use in satellites, the invention will be described in such environment.

Figure 1:
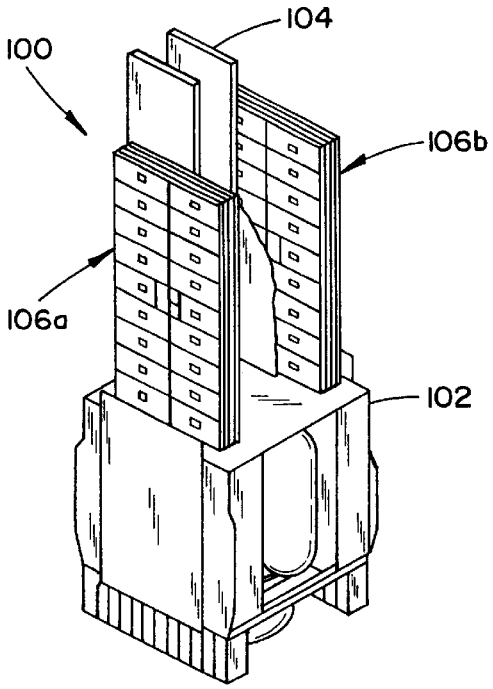
FIG. 1 illustrates a perspective view of a satellite having antenna array sections, the satellite being in a folded configuration so as to fit within the faring of a launch vehicle.
Figure 2:
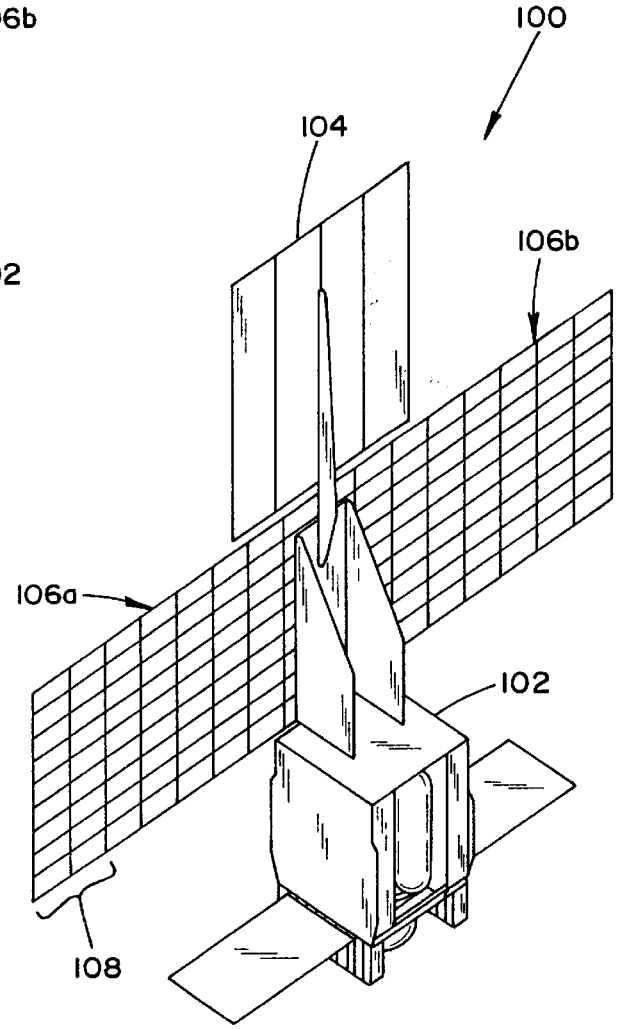
FIG. 2 illustrates the satellite of FIG. 1 in a deployed unfolded configuration.
Figure 3:
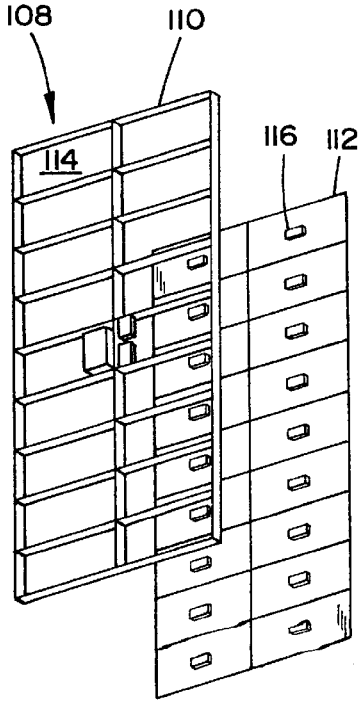
FIG. 3 illustrates an exploded view of an antenna panel of the antenna sections of FIGS. 1 and 2.

FIGS. 1 and 2 are perspective or isometric views of a communications satellite or spacecraft which may make use of the present invention. In FIG. 1, spacecraft 100 includes a body 102, which supports solar panels 104 and antenna sections 106*a*, 106*b*. FIG. 1 illustrates the satellite 100 in a folded configuration in which the antenna sections 106*a* and 106*b* and solar panels 104 are folded or stowed against the body 102 of the satellite 100 during launch so as to fit within the fairing of a launch vehicle and for best support of the antenna sections 106*a*, 106*b*. The antenna sections 106*a*, 106*b* are of similar construction, although they may include portions which operate at different frequencies. All or part of one or both of the antenna receiving sections 106*a*, 106*b* may be transmit or receive antennas. FIG. 2 illustrates the satellite 100 in a deployed configuration in which both the solar panels 104 and antenna sections 106*a*, 106*b* are unfolded or deployed. Each antenna section 106*a*, 106*b* includes, for example, of four deployed panels, one of which is designated 108. FIG. 3 illustrates an exploded view of antenna panel 108. Antenna panel 108 consists of a frame 110 which is typically fabricated from as composite graphite material and an array of radiating tiles 112. The radiating tiles are disposed in corresponding rectangular openings 114 in the frame 110. While antenna panels typically have rectangular tiles and openings, the present invention is not limited to such, the tiles and corresponding openings can be of any shape without departing from the scope or spirit of the present invention.

Each radiating tile 112 includes at least one antenna 116, and may itself include an antenna array. Each radiating tile 112 also provides for distribution of RF signal (which may be at microwave, millimeter wave, or other frequencies) to the various antennas located thereon, as well as amplification, phase shifting, and the like. The electrical power and RF connections do not constitute part of the invention, and are not illustrated. As illustrated in FIGS. 1–3, antenna panel 108 is a 2×9 array of radiating tiles. When each of the tiles 112 has a plurality of antenna elements thereon arranged in an array with a particular inter-element spacing, and tiles 112 are to be assembled into a structure such as the frame 110 for producing a larger array or panel array, it is important to keep adjacent tile boundaries close to each other so that the inter-antenna element spacing at the boundary between tiles 112 differs little from the inter-element spacing on the tiles themselves, to maximize effective isotropic radiated power (EIRP), and to minimize grating lobes. Thus, the elements of the support structure for supporting the tiles 112 in the openings 114 of the frame 110 must be relatively small. The support structure must, however, be sufficiently strong to support each tile in its place, and to withstand launch forces, and other forces which act on the deployed antennas, such as stationkeeping and attitude control, and those forces which act on the support during deployment of the various panels. Furthermore, the support structure must also maintain the spacing and orientation of the tiles notwithstanding substantial temperature fluctuations, such as may occur when the antenna transitions from shadow to sunlight, is shadowed or otherwise non-uniformly illuminated by sunlight and cold space.

Figure 4A:
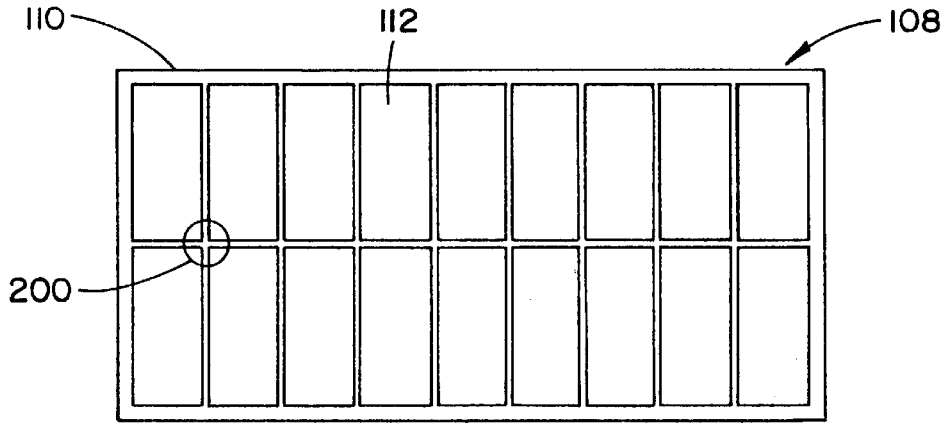
FIGS. 4*a* and 4*b* illustrate a top view and enlarged view of an assembled antenna panel of a first embodiment of the present invention and an intersection of openings of the frame, respectively.
Figure 4B:
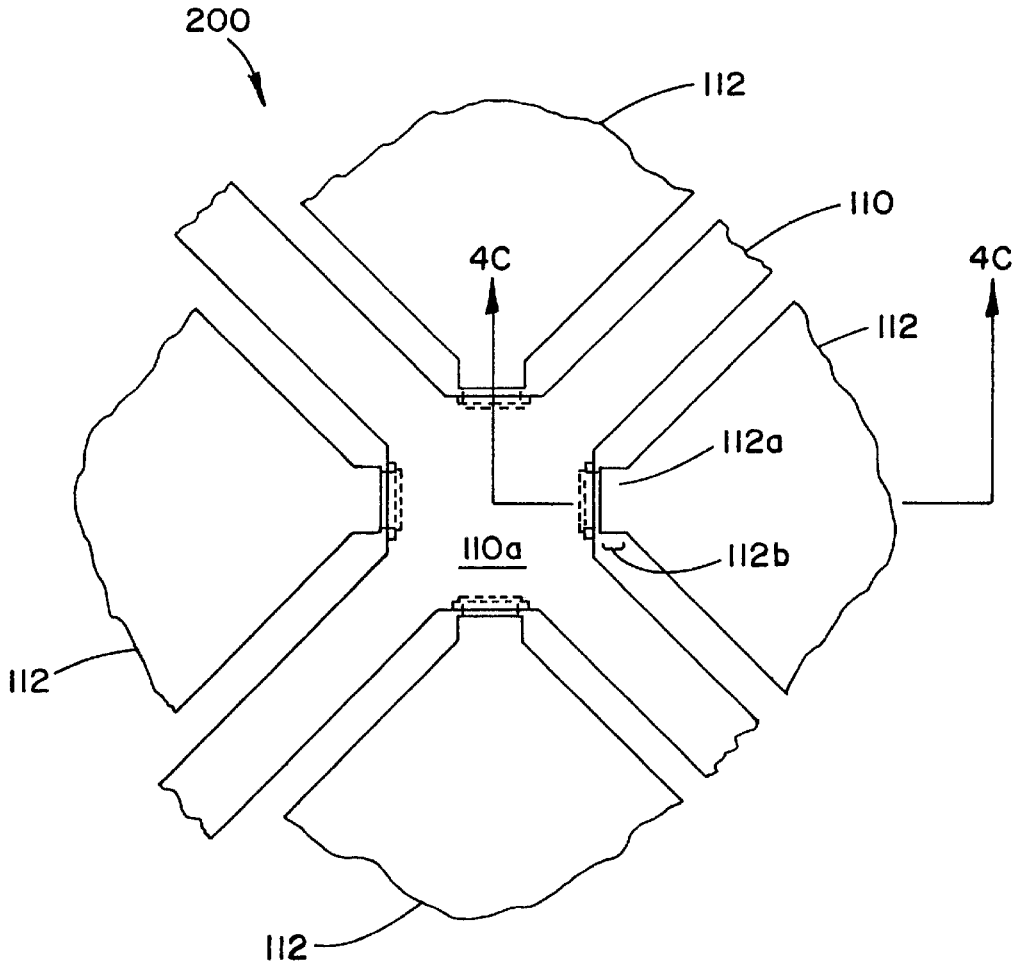

Referring now to FIGS. 4*a* and 4*b*, there is illustrated a top view and enlarged view of an assembled antenna panel 108 of the present invention and an intersection of openings of the frame, respectively. The intersection being referred to generally by reference numeral 200. Intersection 200, shown more clearly in FIG. 4*b* comprises a intersecting portion 110*a* of the frame 110 where four radiating tiles 112 meet and are fastened to the frame 110 at a comer 112*a* of each radiating tile 112. Preferably, the comers 112*a* of the radiating tiles 112 have an extension 112*b* protruding from each of the comers 112*a* of the radiating tile. Although the present invention is described as having a fastening arrangement or mounting means at each of four comers of each of the radiating tiles 112, those skilled in the art will realize that two or more such mounting means can be utilized for each radiating tile 112 without departing from the scope or spirit of the present invention.

Figure 4C:
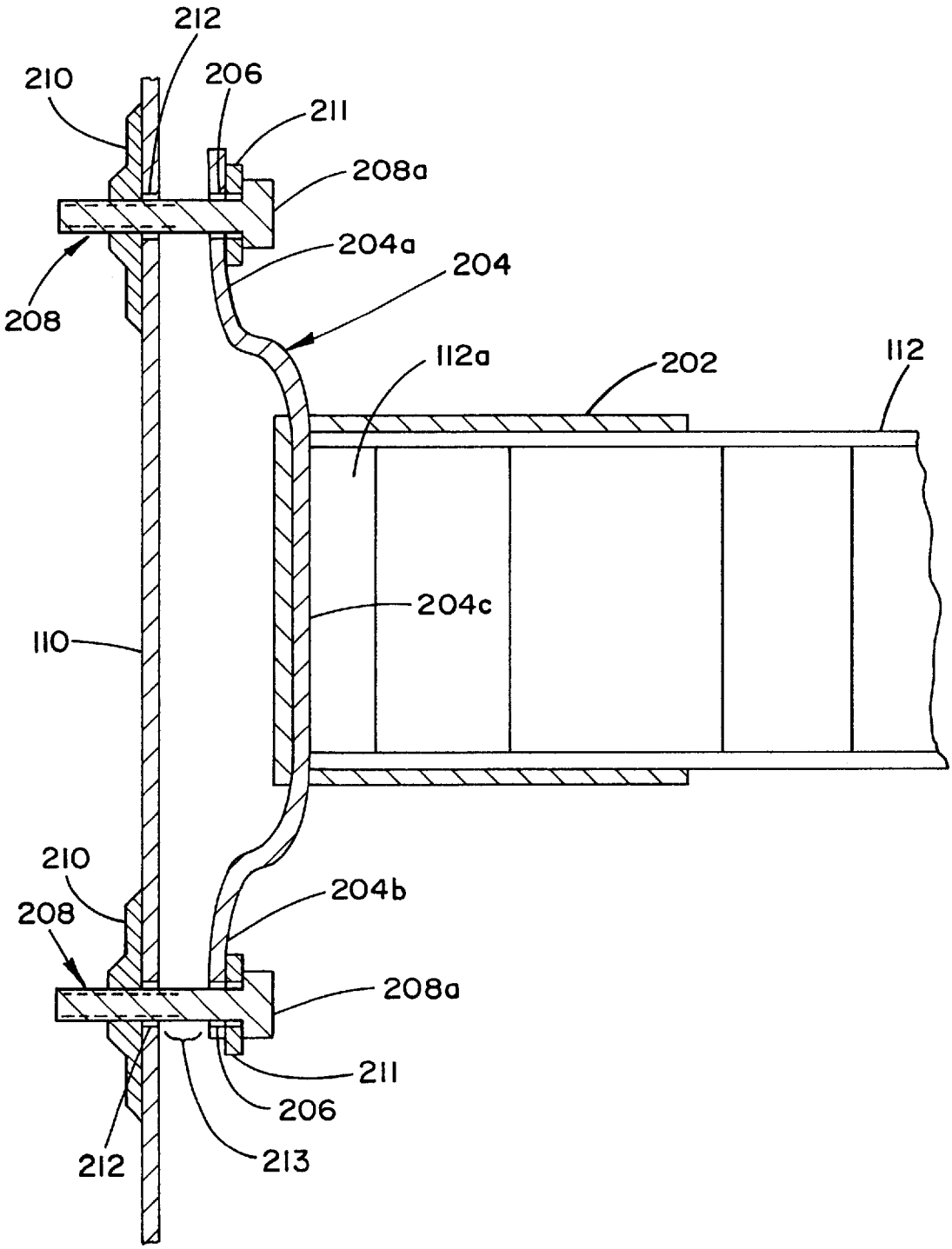
FIG. 4*c* illustrates a sectional view of a support for supporting one comer of the tile to the frame taken along line 4*c*—4*c* in FIG. 4*b*.
Figure 5:
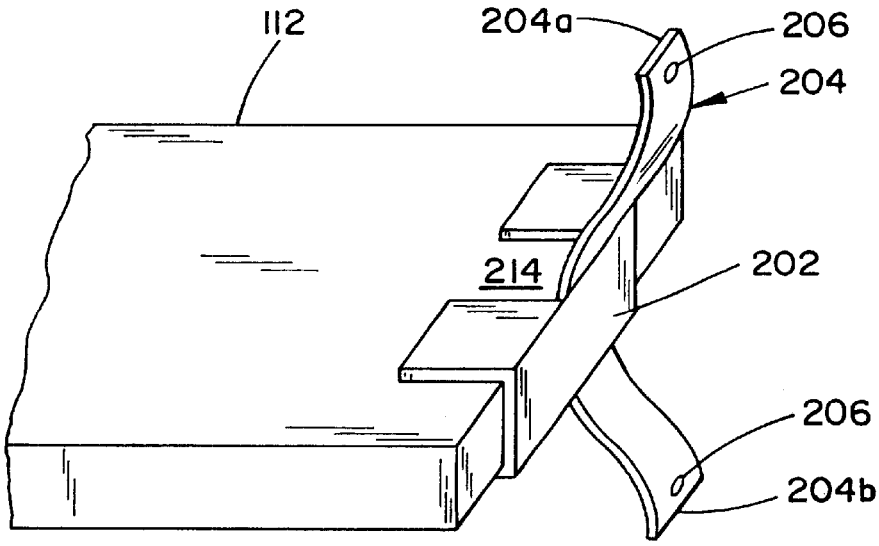
FIG. 5 illustrates a perspective view of a preferred means for fastening a leaf spring to a tile.

A first embodiment of the mounting means of the present invention, which is preferably repeated at each comer 112*a* of each of the radiating tiles 112 in the antenna panel 108, is shown for one such comer 112*a* in FIGS. 4*c* and 5. However, those skilled in the art will realize that such mounting means can be provided at each of two ends, or at two comers and an end, or more than at each comer of each radiating tile 112 without departing from the scope or spirit of the present invention. In the case of flexible tiles which can weigh less than a rigid tile, a mounting means is preferably provided at more than two points, such as at four comers, and the mounting means is preferably symmetrically disposed about the flexible tile. In the case of a flexible tile, the mounting means biases the tile in tension such that the tile tends not to distort.

FIGS. 4*c* and 5 show a comer 112*a* of a radiating tile 112 having a C-shaped clip 202 mounted thereon. The C-shaped clip 202 is preferably fabricated from a suitable metal or composite and mounted with a suitable adhesive which can withstand the environments encountered by communication satellites. The C-shaped clip 202 carries a biasing member 204 which is preferably in the shape of a leaf spring which exerts a biasing force between the frame 110 and a corresponding radiating tile 112. The biasing member 204 is preferably fabricated of a suitable spring metal or composite. The biasing member preferably has a mounting hole 206 at each end thereof 204*a*, 204*b* for mounting the same to the frame 110. FIG. 4*c* illustrates a preferable means for fastening the biasing member to the frame by way of a threaded fastener 208 which is inserted into each mounting hole 206 and which mates with a corresponding threaded insert 210 which is typically press-fit and/or adhered to the frame 110 about a corresponding clearance hole 212. A washer 211 is also preferably provided between a head 208*a* of the threaded fastener 208 and each of the ends 204*a*, 204*b* of the biasing member 204. Preferably a gap 213 is provided between the frame 110 and the ends 204*a*, 204*b*, of the biasing members 204 to allow for spring tension adjustment. FIGS. 4*c* and 5 illustrate the biasing member 204 where the first and second ends 204*a*, 204*b* thereof form an axis perpendicular to the plane of the radiating tile 112 to provide for better clearance which allows the mounting means can be constructed in a smaller space. However, those skilled in the art will realize that the biasing member 204 can also be parallel to the plane of the radiating tile 112 without departing from the scope or spirit of the present invention.

Figure 6A:
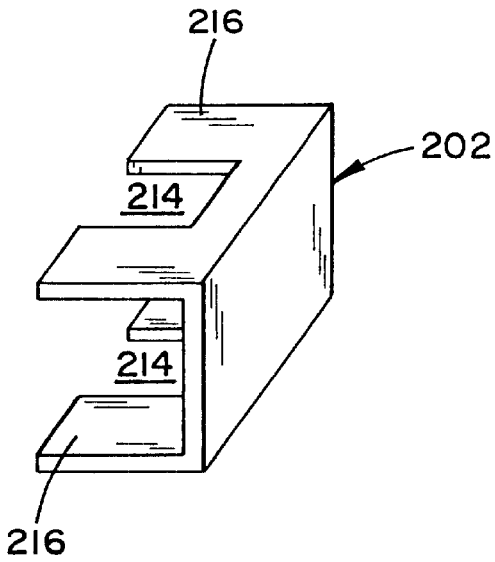
FIGS. 6*a* and 6*b* illustrate perspective views of the clip of FIG. 5 and an alternative clip, Respectively.
Figure 6B:
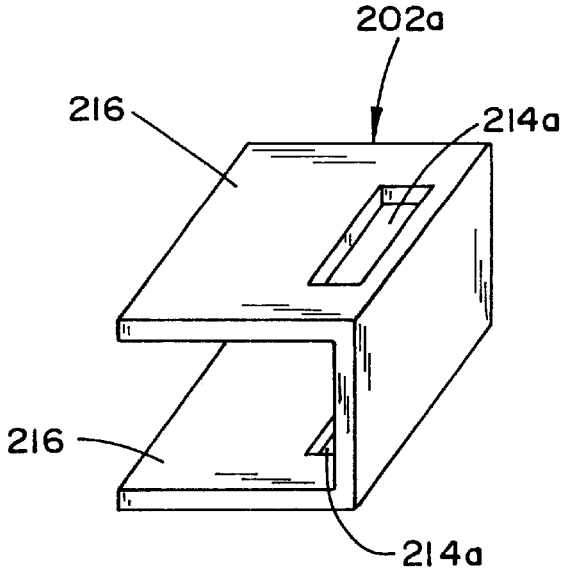

Each biasing member 204 also has a bowed portion 204*c* by which the C-shaped clip 202 is attached to its corresponding tile 112. The bowed portion 204*c* of the biasing member 204 is preferably attached by way of a cut-out 214 in each leg 216 of the C-shaped clip, which is illustrated more clearly in FIGS. 5 and 6*a*. In the C-shaped clip illustrated in FIGS. 5 and 6*a*, the bowed portion 204*c* of the biasing member 204 passes through the cut-out 214 and is sandwiched between the edge of the radiating tile 112 and the C-shaped clip to retain the biasing member 204. FIG. 6*b* illustrates an alternative C-shaped clip 202*a* having a slot 214*a* in each leg 216 of the C-shaped clip 202*a* in which the bowed portion 204*c* of the biasing member 204 passes through to retain the biasing member 204 therein.

In an alternative embodiment of the biasing member 204 of the present invention at least one, and preferably each of the biasing members corresponding to a radiating tile 112 has a means for varying its biasing force with temperature. Preferably, each biasing member 204 comprises a leaf spring having first and second ends 204*a*, 204*b* attached to the frame 110 and a bowed section 204*c* attached to the tile 112 as described above and wherein the means for varying the biasing force with temperature comprises the bow portion 204*c* being fabricated from a first and second material, each having a different coefficient of thermal expansion. Preferably the first and second materials are metals or composites forming a bimetallic, bi-composite, or metal-composite strip. Such metals and composites are well known in the art. As discussed above, in the case of a flexible tile, it is important that the tensioning of the tile is symmetric.

Figure 7A:
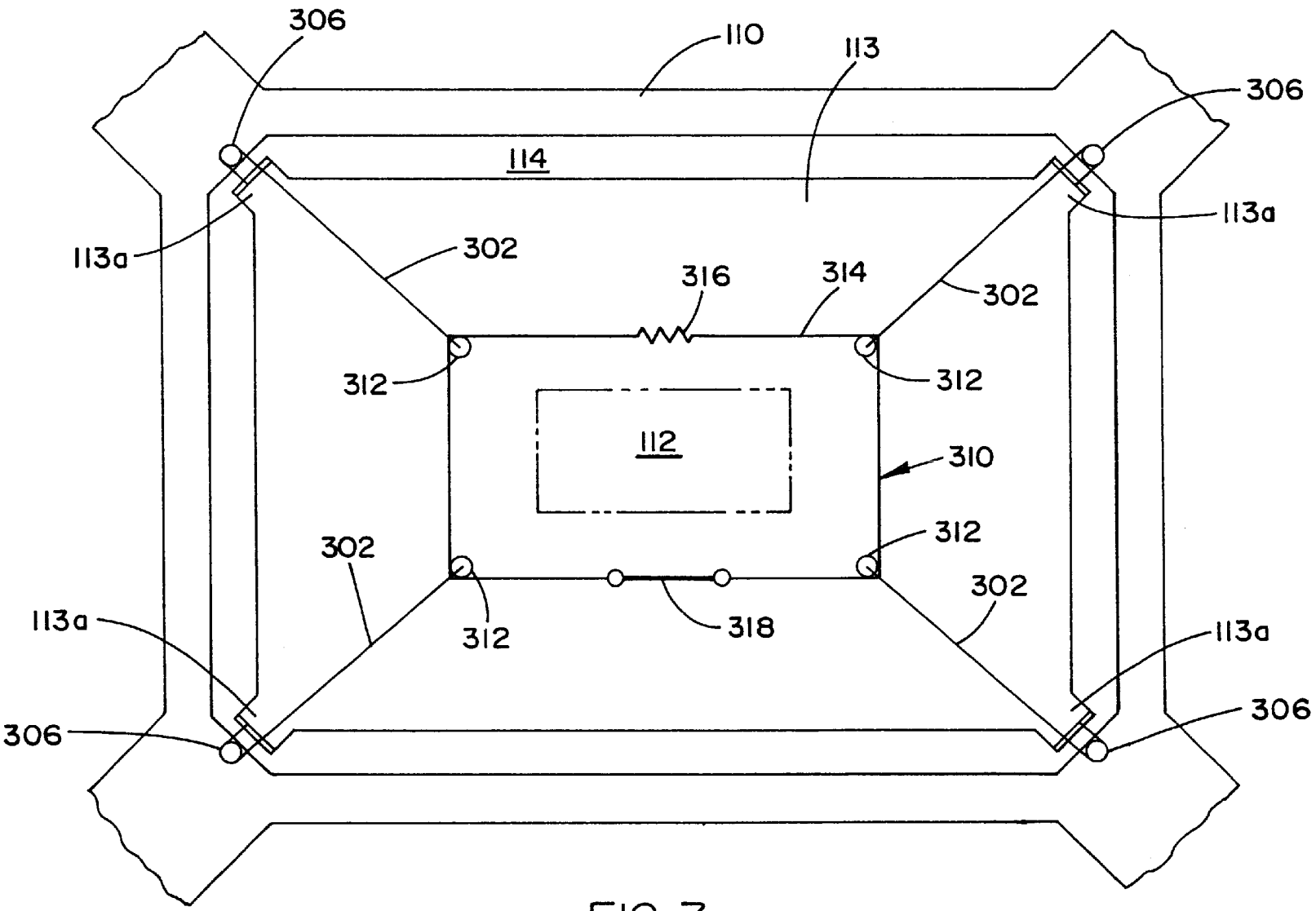
FIGS. 7*a* and 7*b* illustrate a second embodiment of a mounting arrangement for mounting a radiating tile, FIG. 7*a* being a bottom plan view, FIG. 7*b* being a side view.
Figure 7B:
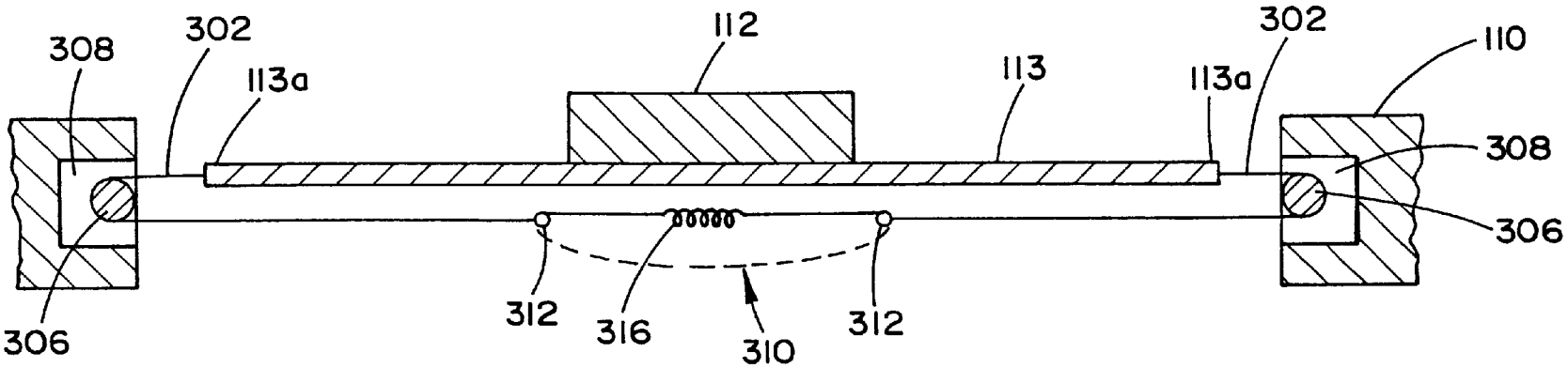
Figure 7C:
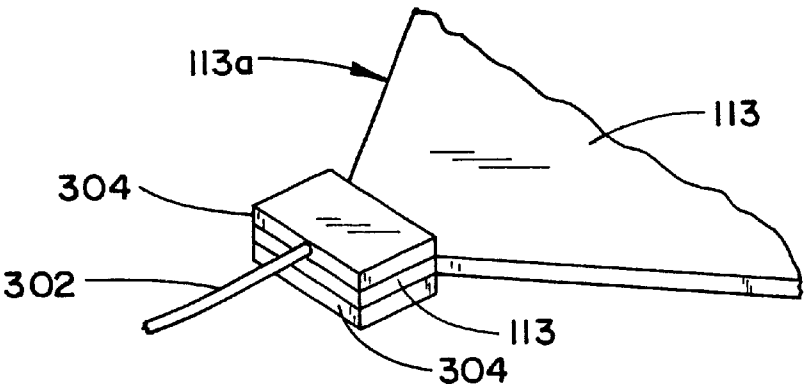
FIG. 7*c* illustrates a corner of a flexible membrane illustrated in FIGS. 7*a* and 7*b*.

Referring now to FIGS. 7*a*, 7*b*, and 7*c*, there is shown an alternative mounting means which maintains the radiating tile 112 in tension. In the embodiment of FIGS. 7*a*, 7*b*, and 7*c*, the radiating tile 112 is mounted on a flexible membrane 113 which is in turn disposed in an opening 114 , preferably rectangular of an eggcrate antenna array structure 116. As illustrated in FIG. 7*c*, a first end of a fine radial wire or fiber 302 (both of which are referred to as a wire) is fixed to each corner 113*a* of the flexible membrane 113 by any means known in the art. Preferably, doublers 304 are provided on both sides of the membrane 113 and secured with adhesive, bolts or rivets (not shown) to sandwich each of the radial wires 302 therein. The doublers 304 not only provide for securing of the radial wires 302 but also provide stiffness at the membrane corners 113*a* as well as load spreading. The doublers 304 are preferably fabricated from a composite material or an engineered plastic. Metal is generally not preferred since it can distort the antenna field.

The radial wire 302 from each of the membrane corners 113*a* is directed over a pulley, pin or other like fitting fixed to the eggcrate structure 110. A pulley 306 is preferred. The pulleys 306 can be fixed inside a recess 308 in the eggcrate structure 110 as illustrated in FIG. 7*b* or alternatively on either of the top or bottom surface of the eggcrate structure 110 with and appropriate mounting member. Each of the radial wires 302 is then fastened to a tensioning yoke arrangement 310 at a second end by a slipable connection. The slipable connection is preferably a pulley 312 which moves freely so that the tension in all four radial wires 302 extending to the membrane comers 113 a is equalized. Preferably, the tensioning yoke arrangement 310 comprises a closed loop of wire 314 which slipingly engages the pulleys 312 from each membrane comer 113*a*. A tensioning means, preferably a tension spring 316 is disposed in the wire loop 314 to maintain the wire loop 314 in tension. Because all four comers 113*a* of the flexible membrane 113 are pulled outwardly, the membrane 113 is in tension and tends to be stretched flat. Because all four tensions are equal, the membrane 113 is under a balanced tension and tends to stay flat. Those skilled in the art will appreciate that all four tensions are equal because all are set by one tensioning means, preferably the spring 316, in the tensioning yoke 310, and because the connections between the tensioning yoke 310 and the four radial tensioning wires 302 are slipable, i.e., free for relative movement, tension equalizes therein which is distributed evenly to the membrane 113.

The mounting means of the embodiment of FIGS. 7*a*, 7*b*, and 7*c* can also be configured to maintain a desired tension on the flexible membrane 113 even when temperature variations are encountered. Preferably, the means to do so comprises disposing a thermal coefficient of expansion (TCE) adjust/control material 318 in the wire loop 314. The TCE material 318 is selected so that it changes in length as temperature changes so as to maintain a desired tension. The desired tension can remain essentially constant, increase with increased temperature, or decrease with increased temperature.

Those skilled in the art will realize that the mounting means of the present invention actively biases each individual radiating tile 112 with respect to the frame 110 in which the tiles are contained and further provides for variations in the biasing for different temperature conditions. Furthermore, the mounting means of the present invention can provide for passive variations in the biasing for different temperature conditions.

While there has been shown and described what is considered to be preferred embodiments of the invention, it will, of course, be understood that various modifications and changes in form or detail could readily be made without departing from the spirit of the invention. It is therefore intended that the invention be not limited to the exact forms described and illustrated, but should be constructed to cover all modifications that may fall within the scope of the appended claims.

What is claimed is:

1. An array antenna comprising:

a frame having a two-dimensional array of a plurality of openings;

an electromagnetically radiating tile disposed in each opening; and mounting means for holding at least one tile in a corresponding opening of the frame, each of the mounting means comprising at least two biasing members, each biasing member exerting a biasing force on the tile relative to the frame.

2. The antenna according to claim 1, wherein the frame lies essentially in a plane, and the plane of each tile is parallel to the plane of the frame.

3. The antenna according to claim 1, wherein each biasing member comprises a leaf spring having first and second ends attached to the frame and a bowed section attached to the tile.

4. The antenna according to claim 3, wherein the biasing member further comprises a C-shaped clip portion, the C-shaped clip portion being disposed over an edge of the tile and retaining the bowed section therebetween.

5. The antenna according to claim 3, wherein the first and second ends form an axis perpendicular to the plane of a corresponding tile.

6. The antenna according to claim 1, wherein the at least two biasing members comprises four biasing members, each of the four biasing members being disposed at a corresponding corner of the tile.

7. The antenna according to claim 1, wherein the tile is flexible and the biasing members maintain the tile in tension.

8. The antenna according to claim 1, wherein the tile transmits and/or receives electromagnetic radiation.

9. The antenna according to claim 6, wherein each of the four biasing members are fastened to the tile at an extension protruding from each of the comers of the tile.

10. The antenna according to claim 1, wherein each biasing member further comprises means for varying the biasing force in response to a change in temperature.

11. The antenna according to claim 10, wherein each biasing member comprises a leaf spring having first and second ends attached to the frame and a bowed section attached to the tile and wherein the means for varying the biasing force in response to a change in temperature comprises the bow portion being fabricated from a first and second material, each said material having a different coefficient of thermal expansion.

12. The antenna according to claim 11, wherein the first and second materials are selected from a group consisting of metals and composites.

13. The antenna according to claim 10, wherein the mounting means comprises a radial tensioning wire fixed to each of four corresponding corners of the tile at a first end and slipably disposed to a tensioning yoke at a second end for maintaining the radial wires and tile in tension, the means for varying the biasing force in response to a change in temperature comprising the tensioning yoke having a portion thereof of temperature compensating material which changes in length with changes in temperature.

14. The antenna according to claim 1, wherein each of the plurality of openings are rectangular and the radiating tiles are rectangular to fit therein.

15. The antenna according to claim 1, wherein the mounting means comprises a radial tensioning wire fixed to each of four corresponding comers of the tile at a first end and slipably disposed to a tensioning yoke at a second end, the tensioning yoke having a tensioning member for maintaining the radial wires and tile in tension.

16. In a spacecraft including a plurality of array antennas, each of the array antennas comprising:

a frame having a two-dimensional array of a plurality of openings;

an electromagnetically radiating tile disposed in each opening; and mounting means for holding at least one tile in a corresponding opening of the frame, each of the mounting means comprising at least two biasing members, each biasing member exerting a biasing force on the tile relative to the frame.

17. The spacecraft according to claim 16, wherein the frame lies essentially in a plane, and the plane of each tile is parallel to the plane of the frame.

18. The spacecraft according to claim 16, wherein each biasing member comprises a leaf spring having first and second ends attached to the frame and a bowed section attached to the tile.

19. The spacecraft according to claim 18, wherein the biasing member further comprises a C-shaped clip portion, the C-shaped clip portion being disposed over an edge of the tile and retaining the bowed section therebetween.

20. The spacecraft according to claim 18, wherein the first and second ends form an axis perpendicular to the plane of a corresponding tile.

21. The spacecraft according to claim 16, wherein the at least two biasing members comprises four biasing members, each of the four biasing members being disposed at a corresponding corner of the tile.

22. The spacecraft according to claim 16, wherein the tile is flexible and the biasing members maintain the tile in tension.

23. The spacecraft according to claim 16, wherein the tile transmits and/or receives electromagnetic radiation.

24. The spacecraft according to claim 21, wherein each of the four biasing members are fastened to the tile at an extension protruding from each of the comers of the tile.

25. The spacecraft according to claim 16, wherein each biasing member further comprises means for varying the biasing force in response to a change in temperature.

26. The spacecraft according to claim 25, wherein each biasing member comprises a leaf spring having first and second ends attached to the frame and a bowed section attached to the tile and wherein the means for varying the biasing force in response to a change in temperature comprises the bow portion being fabricated from a first and second material, each said material having a different coefficient of thermal expansion.

27. The spacecraft according to claim 26, wherein the first and second materials are selected from a group consisting of metals and composites.

28. The spacecraft according to claim 25, wherein the mounting means comprises a radial tensioning wire fixed to each of four corresponding corners of the tile at a first end and slipably disposed to a tensioning yoke at a second end for maintaining the radial wires and tile in tension, the means for varying the biasing force in response to a change in temperature comprising the tensioning yoke having a portion thereof of temperature compensating material which changes in length with changes in temperature.

29. The spacecraft according to claim 16, wherein each of the plurality of openings are rectangular and the radiating tiles are rectangular to fit therein.

30. The spacecraft according to claim 16, wherein the mounting means comprises a radial tensioning wire fixed to each of four corresponding corners of the tile at a first end and slipably disposed to a tensioning yoke at a second end, the tensioning yoke having a tensioning member for maintaining the radial wires and tile in tension.

31. An array antenna comprising:

a frame having a two-dimensional array of a plurality of openings;

a flexible electromagnetically radiating tile disposed in each opening; and mounting means for holding at least one tile in a corresponding opening of the frame, each of the mounting means comprising at least two biasing members, each biasing member exerting a biasing force on the tile relative to the frame to maintain the tile in tension.

32. In a spacecraft including a plurality of array antennas, each of the array antennas comprising:

a frame having a two-dimensional array of a plurality of openings;

a flexible electromagnetically radiating tile disposed in each opening; and mounting means for holding at least one tile in a corresponding opening of the frame, each of the mounting means comprising at least two biasing members, each biasing member exerting a biasing force on the tile relative to the frame to maintain the tile in tension.

33. An array antenna comprising:

a frame having a two-dimensional array of a plurality of openings;

an electromagnetically radiating tile disposed in each opening; and mounting means for holding at least one tile in a corresponding opening of the frame, each of the mounting means comprising at least two biasing members, each biasing member exerting a biasing force on the tile relative to the frame, each biasing member further having means for varying the biasing force in response to a change in temperature.

34. In a spacecraft including a plurality of array antennas, each of the array antennas comprising:

a frame having a two-dimensional array of a plurality of openings;

an electromagnetically radiating tile disposed in each opening; and mounting means for holding at least one tile in a corresponding opening of the frame, each of the mounting means comprising at least two biasing members, each biasing member exerting a biasing force on the tile relative to the frame, each biasing member further having means for varying the biasing force in response to a change in temperature.

* * * * *